US005826590A

United States Patent [19]

Metzner et al.

[11] Patent Number: 5,826,590

[45] Date of Patent: Oct. 27, 1998

[54] METHOD AND PLANT FOR TREATING TOBACCO STEMS FOR THE PRODUCTION OF CUT TOBACCO

[75] Inventors: Wolfgang Metzner, Hamburg; Bernd Spallek, Syke; Arno Weiss, Norderstedt, all of Germany

[73] Assignee: Brown & Williamson Tobacco Corp., Louisville, Ky.

[21] Appl. No.: 937,112

[22] Filed: Sep. 24, 1997

[30] Foreign Application Priority Data

| | | | |
|---|---|---|---|
| Sep. 26, 1996 | [EP] | European Pat. Off. | 96115458 |
| Nov. 14, 1996 | [DE] | Germany | 196 47 147.8 |

[51] Int. Cl.[6] ..... A24B 5/00

[52] U.S. Cl. ..... 131/290; 131/291

[58] Field of Search ..... 131/290, 291, 131/140–144, 296, 304, 305, 306

[56] References Cited

U.S. PATENT DOCUMENTS

| | | | |
|---|---|---|---|
| 3,219,042 | 11/1965 | Molins | 131/290 |
| 3,513,857 | 5/1970 | Silberman | 131/290 |
| 3,556,112 | 1/1971 | dela Burde | 131/290 |
| 3,599,645 | 8/1971 | Johnson | 131/140 |
| 4,366,823 | 1/1983 | Rainer et al. | 131/290 |
| 4,388,933 | 6/1983 | Rainer et al. . | |
| 4,583,559 | 4/1986 | Hedge | 131/304 |
| 4,696,312 | 9/1987 | Turano et al. | 131/290 |
| 5,526,581 | 6/1996 | Winnterson et al. | 34/474 |

FOREIGN PATENT DOCUMENTS

| | | |
|---|---|---|
| 0 049 534 A1 | 10/1981 | European Pat. Off. . |
| 0 301 217 B1 | 2/1993 | European Pat. Off. . |
| 0 774 212 A1 | 5/1997 | European Pat. Off. . |
| 2 336 093 A | 7/1977 | France . |
| 14 32 585 A | 11/1968 | Germany . |
| 19 21 072 C3 | 11/1970 | Germany . |
| PS 19 21 072 | 11/1970 | Germany . |
| PS 16 57 230 | 5/1972 | Germany . |
| 24 02 538 C2 | 7/1975 | Germany . |
| 27 31 871 | 1/1978 | Germany . |
| 29 21 025 | 11/1979 | Germany . |
| 29 13 823 A1 | 10/1980 | Germany . |
| 34 46 642 C2 | 7/1985 | Germany . |
| 37 10 677 C2 | 10/1988 | Germany . |
| 40 29 566 A1 | 3/1991 | Germany . |
| 40 29 567 A1 | 3/1991 | Germany . |
| 195 43 262 A1 | 5/1997 | Germany . |
| 196 47 147 A1 | 6/1997 | Germany . |
| 504 535 A | 2/1976 | U.S.S.R. . |
| 69 55 27 | 7/1977 | U.S.S.R. . |
| 1 365 791 | 10/1972 | United Kingdom . |
| 2026298 | 5/1979 | United Kingdom . |
| 2 078 085 | 3/1981 | United Kingdom . |
| 2118817 | 11/1982 | United Kingdom . |
| 2131671 | 10/1983 | United Kingdom . |
| WO 94 10864 | 5/1994 | WIPO . |

*Primary Examiner*—John G. Weiss
*Assistant Examiner*—Charles W. Anderson
*Attorney, Agent, or Firm*—Armstrong, Westerman, Hattori, McLeland & Naughton

[57] ABSTRACT

The invention relates to a method and plant of treating tobacco stems for the production of cut tobacco for smokable articles, wherein uncut stem are sauced to a moisture content of approximately 45% at the maximum, the sauced stems are overdried to a moisture content of less than approximately 12%, and the overdried stems are remoistened to the processing moisture content for the subsequent stem process, e.g. a CRS process.

17 Claims, 2 Drawing Sheets

METHOD AND PLANT FOR TREATING TOBACCO STEMS FOR THE PRODUCTION OF CUT TOBACCO

BACKGROUND OF THE INVENTION

1. Field of the Invention

The invention relates to a method and a plant for treating tobacco stems for the production of cut tobacco for smokable articles.

2. Description of the Prior Art

Tobacco leaves, from which smokable articles, particularly cigarettes as well as fine-cut for self-produced cigarettes, are obtained, consist of lamina and stems which, on the one hand, greatly differ in consistency and, on the other, greatly differ in taste perception and thus influence both the technique in preparing the tobacco and the taste perception of the respective smokable article to a very great extent, albeit differingly.

To get round the problems associated with the treatment of stems and the effects in taste caused by the stems, it is thus usual to separate the stems from the lamina and to use only the lamina for the production of cigarettes. Due to the percentage of stems in the overall weight of the tobacco leaves making up to roughly 30% by weight, this method represents, however, a very costly waste of the valuable "tobacco leaf" raw material.

This is why it has already been attempted to process whole tobacco leaves by specific methods of size reduction employing shear forces into a flowable blend of lamina particles and stem particles which may be put to use directly in cigarette production. This method, described for example in DE 40 29 566 A1, has, however, never been put into practice, since the taste properties failed to come up to expectations.

A mixed solution is disclosed by DE 40 29 567 A1 in which whole leaves are processed into a blend of lamina particles and substantially intact stem pieces in a method of size reduction employing shear forces; the stem pieces need to be subsequently separated out, the lamina particles then being directly supplied to cigarette production. Transferring this method into actual practice also failed due to the taste problems still waiting to be solved.

A further method is disclosed by GB 2,026,298 A, in which tobacco leaves are reduced in size to particles which are suitable for cigarette production. By means of an air separating method the leaf particles are fractionated into a more heavy fraction containing the stems and a lighter lamina fraction free of stems, the heavier fraction being threshed, so as, in this case, too, to still separate the lamina from the stems. The separated lamina and the lighter fraction originally obtained are then blended to be supplied to cigarette production. This method is highly complicated, the same also applying to the similar method according to U.S. Pat. No. 4, 696,312.

It is thus still the usual practice to disintegrate the tobacco leaves into stems, on the one hand, and lamina, on the other, which is usually done in the country of origin shortly after harvesting. Stems and lamina are packaged separate from each other and shipped to the place of deployment where the so-called "tobacco preparation" is done. In this tobacco preparation the stems, on the one hand, and the lamina, on the other, are treated separately from each other, namely conditioned, i.e. subjected to moisture and heat treatment, cut and dried, before being finally blended and then subjected jointly to further processing, as a rule involving the addition of flavoring materials.

The basic principles of this method, by which both fine-cut and also cigarettes can be produced are described in the book "Tobacco Encylopedia" published by Ernst Voges, 1984, in the article "Cigarette Manufacture I and II", more particularly under the heading "The Production of Cut Tobacco".

In this generally used method, stems, on the one hand, and lamina, on the other hand, are run on processing lines totally separated from each other, the so-called "stem line" and the so-called "lamina line", each of which comprise conditioning means, cutting means, saucing means for applying casing, heating means and driers. On the stem line a rolling mill is also needed for the purpose of rolling out the stems prior to the cutting process to generate the "CRS" (cut rolled stems), i.e. the rolled and cut stem pieces that are then added to the lamina directly upstream of the flavor drum.

For the processing of tobacco stems alone, different methods have been developed. From German patent specification 19 21 071 follows an apparatus for increasing the moisture content of tobacco stems, where the heated sauce (casing) is applied to the stems, which are then heated in a heated drum. After the subsequent drying, the stems are subjected to rolling.

Furthermore, U.S. Pat. No. 3,513,857 shows a method for treating tobacco stems that are softened and heated with a mixture of enzymes and casing and are then flattened, for example by rolling or shearing. Afterwards, the stems are dried and cut. The aim of this method is the insertion of the enzyme solution into the stems.

There is still a need for a method and plant for treating tobacco stems for the production of cut tobacco, which ensure a very homogeneous and steady or uniform preparation of the tobacco stems.

SUMMARY OF THE INVENTION

The invention is thus based on the object of providing a method and a plant for the treatment of tobacco stems for the production of cut tobacco, in which the aforementioned drawbacks are not encountered.

In particular it is intended to propose a method and a plant that guarantee the optimum preparation of stems, in particular of stem blends, for the subsequent normal stem process.

According to a first aspect, this object is achieved by a method for treating tobacco stems for the production of cut tobacco. According to a second aspect this object is achieved by a plant for treating tobacco stems for the production of cut tobacco.

Expedient embodiments are defined by the features of the corresponding sub-claims.

The advantages achieved by the invention are based on the fact that by moistening the stems with a sauce and the subsequent overdrying, the raw stems are moistened thoroughly and very homogeneously, which is a great advantage, in particular when the today commonly used stem blends are employed, since the individual stem sorts as a rule show a different moistening behaviour and, thus, the moisture content usually employed until now did not always lead to a homogeneous treatment of the stems. Furthermore, said stems have a better cutting behaviour when they are fed to the subsequent stem process, for example the above-mentioned CRS method, thus leading again to a lower occurence of winnowings.

Expediently, the stems are sauced with a moisture content of approximately 45% at the maxium, in particular with a moisture content of about 35%, since thereby the power consumption can be further lowered.

Expediently, the sauce is heated to a temperature between approximately 30° to 50° C., in particular to a temperature between approximately 40° to 45° C. before it is applied to the uncut stems in order to thereby also support the permeation of sauce into the stems and, thus, support a thoroughly homogeneous moistening.

"Overdrying" of sauced stems means drying to a moisture content that lies under the usual moisture content of untreated stems of approximately 18%. Particularly good results are achieved by overdrying to a moisture content of less than approximately 10%, preferrably to a moisture content of approximately 8%, in order to drive the sauce into the stems.

The overdrying of sauced stems is expediently effected in a steam drier, in particular a drum drier or a Burley drier, as they are available in the usual tobacco preparation.

According to a preferred embodiment, the sauced and overdried stems are remoistened, for example in a conditioning drum or the last chamber of said Burley drier, ensuring the optimum moisture for the subsequent stem process.

For this method, two different stem types may be principally used, namely, at the one hand, untreated stems, as they are supplied from the producing countries to the cigarette manufacturers, or, on the other hand, untreated stems that are preconditioned to a moisture content between approximately 16% and 20%, in particular approximately 17% or 18%, by means of a steam treatment.

Said preconditioned stems are, due to a preferred embodiment, held covered in a closed cover for at least 1.5 h, in particular approximately 2 h, so that the complete stem blend is able to achieve said moisture content, thereby resulting in a very homogeneous state of the total stem mass.

The stems prepared in this way may be subjected to either the above-mentioned CRS process or to one of the new stem processes as they are described in German patent application 195 43 262 or in European patent application 96 115 458.0.

BRIEF DESCRIPTION OF THE DRAWINGS

The invention will be explained in detail hereinafter on the basis of embodiments with reference to the attached schematic drawings in which.

DESCRIPTION OF THE PREFERRED EMBODIMENTS

Figure 1:
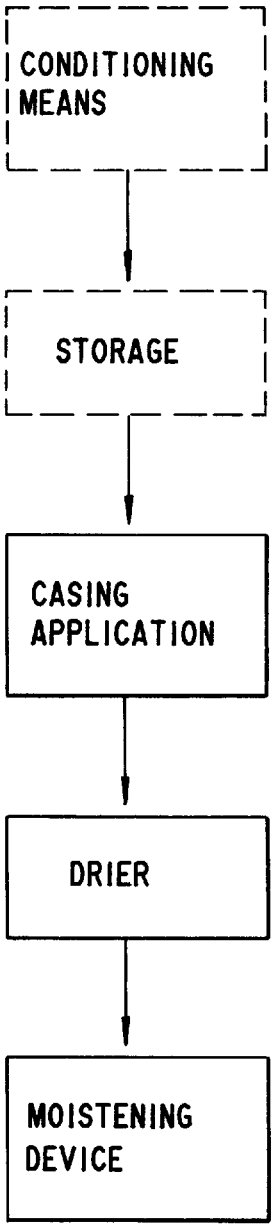
FIG. 1 shows a flow chart of a plant for the treatment of tobacco stems.

With a plant according to FIG. 1, the untreated stems are optionally preconditioned in a conditioning device by bringing them to a moisture content of approximately 17% or 18% by means of a steam treatment.

These preconditioned stems are held in a closed cover for approximately 2 h.

These two steps are optional, e. g., as an alternative hereto, untreated stems may be also supplied to the first processing step, namely the casing supply where a sauce, heated to a temperature of approximately 45° is applied to the stems, which thereby achieve a moisture content of approximately 35%. Said application of casing is effected in a saucing drum.

The subsequent overdrying of moistened stems is carried out in a drum drier or Burley drier and leads to a moisture content of approximately 8%.

As a next step, the overdried stems are remoistened in a conditioning drum or in the last chamber of the Burley drier to approximately 33% and then fed to the stem cutter.

Figure 2:
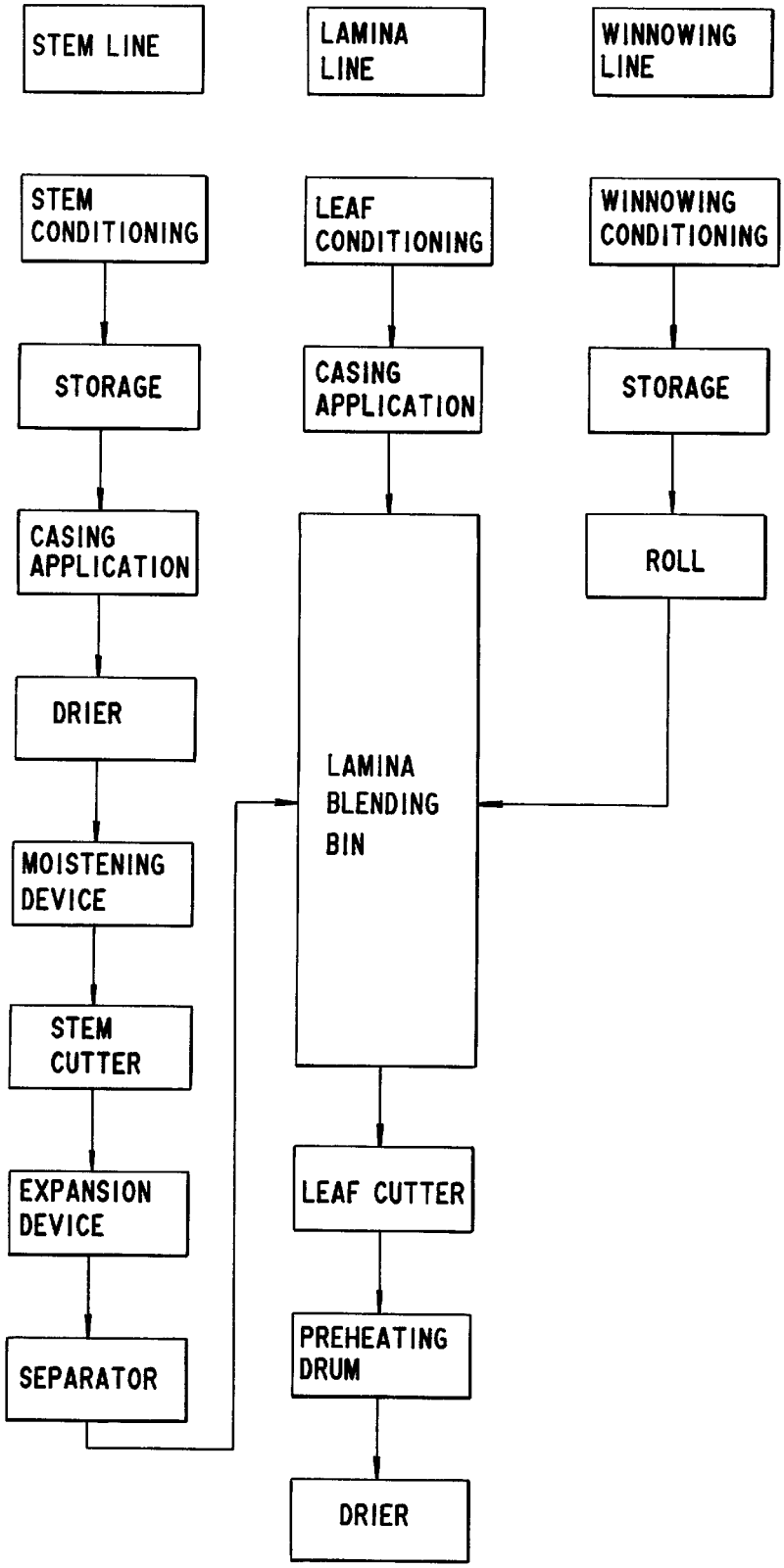
FIG. 2 shows a flow chart of a complete plant for the production of cut tobacco from stems, lamina and winnowings.

FIG. 2 shows an embodiment of a plant for the production of cut tobacco for smokable articles where the tobacco stems prepared according to the invention are temporarily treated alone and are then again blended with lamina and winnowings as described in European patent application 96 115 458.0. This blend is subsequently processed to tobacco rods.

With this method, the stems prepared in the plant according to FIG. 1, which have a moisture content of approximately 33%, are fed to a stem precutter, the preferred cutting width of which is approximately 0.2 mm.

If required, the precut stems are again provided with casing.

Afterwards, the precut stems are subjected to an expanding method as it is e. g. known from German patent specification 37 10 677. From the expanding device, the expanded stems are supplied to a separator, which separates the fluid that was used for expanding. The separator according to European patent specification no. 0 31 217 may be used herefor.

The precut and expanded stems are then fed to a charging chute leading to a blending bin (lamina blending box) to which also preconditioned lamina material is supplied. Provided upstream of this blending bin is a conditioning drum for the lamina, in which lamina for the cigarette production obtains a moisture content of approximately 17.5% and lamina for the fine-cut production obtains a moisture content of approximately 24%.

Between the conditioning means and the blending bin, a saucing means is provided for applying casing to the lamina.

In addition, generally next to said stem line and said lamina line a "winnowing line" is also provided, to which the winnowings incurred in the course of the tobacco preparation are supplied. Said winnowings are conditioned in a steam tunnel, which is working with water as well as steam, the winnowings, thus, leaving conditioning with a moisture content of approximately 30% to 35%.

The conditioned winnowings are held covered for approximately 2 h and are then rolled in a roll having a gap width of approximately 0 mm.

The rolled and conditioned winnowings are subsequently fed to the blending bin (lamina blending box) via a further charging chute.

The blend of stems, lamina and winnowings from the blending bin is cut with a cutting width of approximately 0.85 mm for the production of cigarettes and a cutting width of approximately 0.4 mm for fine-cut production, there being practically no change in the moisture content of the blend.

The cut blend of lamina, stems and winnowings reaches a preheating drum where it is moistened with water and steam and heated so that it leaves the preheating drum with a moisture content of approximately 22%.

Subsequently, this blend is dried in a hot-air drier from which it emerges with a moisture content of approximately 14.5.%, and is then forwarded to the further steps of the tobacco preparation, for example a cooling and sieve drum as well as a flavor drum.

As an alternative to the embodiment according to FIG. 2, a plant without winnowing line may also be used, i. e., only pretreated stems and pretreated lamina are blended in the lamina blending box and then supplied to further processing.

We claim:

1. A method of treating tobacco stems for the production of cut tobacco for smokable articles, comprising:

a) saucing uncut stems to a moisture content of approximately 45% at the maximum, b) overdrying the sauced stems to a moisture content of less than approximately 12%, and c) remoistening the overdried stems for a subsequent stem process.

2. The method as set forth in claim 1, wherein said stems are sauced to a moisture content of approximately 40% at the maximum, in particular to a moisture content of approximately 35%.

3. The method as set forth in claim 1, wherein the sauce, prior to its application to the uncut stems, is heated to a temperature between approximately 30° and 50° C., in particular to a temperature between approximately 40° and 45° C.

4. The method as set forth in claim 1, wherein the sauced stems are overdried to a moisture content of less than approximately 10%, in particular to a moisture content of approximately 3% to approximately 10%, preferably to a moisture content of approximately 8%.

5. The method as set forth in claim 1, wherein the sauced stems are overdried in a steam drier, especially a drum drier or a Burley drier.

6. The method as set forth in claim 1, wherein the overdried stems are remoistened in a conditioning drum or in the last chamber of a Burley drier.

7. The method as set forth in claim 1, wherein the untreated stems are sauced.

8. The method as set forth in claim 1, wherein the untreated stems are preconditioned by a steam treatment to a moisture content between approximately 16% and 20%, in particular of approximately 17% or 18%.

9. The method as set forth in claim 8, wherein said preconditioned stems are stored for at least 1.5 h, in particular approximately 2 h, in a closed cover.

10. The method as set forth in claim 1, wherein the remoistened stems are supplied to a CRS process.

11. The method as set forth in claim 1, wherein the remoistened stems are precut, blended with conditioned lamina and are then cut and dried jointly with the lamina.

12. The method as set forth in claim 11, wherein the stems are precut with a cutting width of approximately 0.1 to approximately 0.3 mm, in particular of approximately 0.2 mm.

13. The method as set forth in claim 11, wherein said precut stems are expanded.

14. The method as set forth in claim 11, wherein approximately 30% of precut stems at the maximum, in particular approximately 5 to 25% of precut stems, each percentage referring to the total amount, are added to the lamina.

15. The method as set forth in claim 11, wherein lamina and stems are cut for the production of cigarettes to a cutting width of approximately 0.5 to 2 mm, in particular to approximately 0.85 mm, while, for the fine-cut production, lamina and stems are cut to a cutting width of approximately 0.35 to approximately 0.5 mm, in particular to approximately 0.45 mm.

16. The method as set forth in claim 11, wherein subsequent to their cutting, lamina and stems are brought to a moisture content of approximately 18% to approximately 39%, in particular of approximately 19.5% to approximately 24%, preferrably approximately 22%, and are then dried to a moisture content of approximately 13 to 16%, in particular approximately 14%.

17. The method as set forth in claim 11, wherein conditioned and rolled winnowings are added to the blend of cut stems and lamina.

* * * * *